US008055168B2

(12) United States Patent
Groenen et al.

(10) Patent No.: US 8,055,168 B2
(45) Date of Patent: Nov. 8, 2011

(54) MAGNET KNIFE ASSEMBLY FOR A TONER DEVELOPING DEVICE

(75) Inventors: Paulus A. C. Groenen, Venray (NL); Henricus A. M. Janssen, Horst (NL)

(73) Assignee: Oce-Technologies B.V., Venlo (NL)

( * ) Notice: Subject to any disclaimer, the term of this patent is extended or adjusted under 35 U.S.C. 154(b) by 463 days.

(21) Appl. No.: 12/327,457

(22) Filed: Dec. 3, 2008

(65) Prior Publication Data

US 2009/0148196 A1 Jun. 11, 2009

(30) Foreign Application Priority Data

Dec. 7, 2007 (EP) ..... 07122611

(51) Int. Cl.
*G03G 15/09* (2006.01)

(52) U.S. Cl. ..... 399/267; 377/277

(58) Field of Classification Search ..... 399/267, 399/277

See application file for complete search history.

(56) References Cited

U.S. PATENT DOCUMENTS 4,354,454 A 10/1982 Nishikawa
4,884,188 A * 11/1989 Berkhout et al. ..... 347/158
5,449,315 A * 9/1995 Friel ..... 451/282
5,574,546 A * 11/1996 Kumasaka et al. ..... 399/276
5,812,921 A * 9/1998 Van Reuth ..... 399/276
5,860,049 A * 1/1999 Kumasaka et al. ..... 399/267
7,548,250 B2 * 6/2009 Van Acquoij et al. ..... 347/148

FOREIGN PATENT DOCUMENTS

EP 0 298 532 A1 1/1989
EP 0 304 983 A1 3/1989
EP 0 310 209 A1 4/1989
EP 0 773 484 A1 5/1997

* cited by examiner

*Primary Examiner* — David Gray
*Assistant Examiner* — G. M. Hyder
(74) *Attorney, Agent, or Firm* — Birch, Stewart, Kolasch & Birch, LLP

(57) ABSTRACT

A magnet knife assembly for a toner developing device including a ferromagnetic strip held between like poles (N) of two permanent magnets such that a knife edge portion of the strip projects outwardly beyond the two magnets and is subject to a magnet force that tends to urge the strip in a direction in which the knife edge projects further out of the magnets, wherein the length of the strip is selected such that a portion of the strip opposite to the knife edge is subject to a magnetic force that at least counterbalances said magnetic force on the knife edge portion.

11 Claims, 3 Drawing Sheets

MAGNET KNIFE ASSEMBLY FOR A TONER DEVELOPING DEVICE

This non-provisional application claims priority under 35 U.S.C. §119(a) on European Patent Application No. 071122611.2 filed in the European Patent Office on Dec. 7, 2007, which is herein incorporated by reference

BACKGROUND OF THE INVENTION

The present invention relates to a magnet knife assembly for a toner developing device, comprising a support body and a ferromagnetic strip that is held between like poles of two permanent magnets and extends between these poles from a knife edge that faces outwardly of the support body to an inner edge facing inwardly of the support body, the strip being held such that an outer knife edge portion of the strip projects outwardly beyond the two magnets and is subject to a magnetic force that tends to urge the strip in a direction in which the knife edge portion projects further out of the magnets.

A magnet knife assembly of this type is used in toner developing devices for printers, copiers and the like for creating, along the knife edge, a localized strong and strongly divergent magnetic field, so that, when magnetically attractable toner particles are supplied into that field, they will form a magnetic brush extending along the knife edge and across an image forming medium so as to assist in the transfer of the toner onto the image forming medium.

Typically, the magnet knife assembly is held stationary relative to the path along which the image forming medium is moved, and is surrounded by a thin sleeve, so that the knife edge faces the internal surface of the sleeve and the magnetic field penetrates through the wall of the sleeve towards the image forming medium. Toner particles may then be supplied to the magnetic field by distributing the toner on the surface of the sleeve and rotating the sleeve so that the toner approaches the magnet field created by the knife edge.

In order to obtain a high and constant quality of the developed image, certain parameters of the magnet field created at the knife edge must fulfil a number of criteria. For example, the absolute strength of the magnetic field directly above the knife edge should be relatively high, and the field should further be highly inhomogeneous, i.e., the gradient of the radial component of the magnetic field above the knife edge should also be high. Moreover, the angle a which the magnetic field vector forms with the surface of the sleeve (the tangent plane thereof at the position above the knife edge) should be relatively high and should be larger than 45° over a certain distance in the circumferential direction of the sleeve.

Magnet knife assemblies of the type indicated above are disclosed in EP 0310209A, EP 0298532A and EP 0773484A.

EP 0304983A discloses another magnet knife assembly of this type that was optimised in view of the above requirements. In this magnet knife assembly, the two permanent magnets have rectangular cross-sections that may be chamfered on the sides facing away from the ferromagnetic strip interposed therebetween. The plane of the strip is inclined at an angle of about 15° relative to the radial direction of the sleeve. It has been found that, for this configuration, the absolute strength and the inhomogenity of the magnetic field above the knife edge increases when the length of the strip (essentially in the radial direction of the sleeve) is reduced. For that reason, the length of the strip is shorter than the length of the two magnets. This has the consequence that the magnetic force tends to push the knife edge portion of the strip away from the magnets, i.e., tends to cause the strip to project further from the magnets.

For this reason, it is necessary in the known assembly that the strip is mechanically fixed at a support structure that carries the two magnets, e.g., by gluing the strip and the magnets to the support structure with an adhesive, by clamping the strip and/or the magnets with fastening screws, and the like. However, the necessity to fix the strip and the magnets in their desired positions requires cumbersome procedures and therefore increases the production costs for the magnet knife assembly as a whole. Moreover, differential thermal expansion of the magnet knife assembly and the support structure may lead to undesired mechanical strains and distortions.

SUMMARY OF THE INVENTION

Accordingly, it is an object of the present invention to provide a magnet knife assembly which can be produced at reduced costs without substantial sacrifices in the quality of the magnetic field.

According to the present invention, this object is achieved by a magnet knife assembly of the type indicated above, wherein a length L0 of the strip from said knife edge to the inner edge is selected such that a portion of the strip opposite to the knife edge and closer to the inner edge is subject to a magnetic force that is larger than the force acting upon the knife edge portion, and the strip is held in position relative to the support body in the direction from the knife edge to the inner edge only by magnetic forces of the magnets that urge the inner edge of the strip against the support body.

The assembly according to the invention has the advantage that the additional magnetic forces on the strip, which tend to counterbalance the forces exerted onto the knife edge portion of the strip, can be utilized for a self-aligning effect which significantly reduces or completely eliminates the need for additional fastening means for fastening the strip relative to the magnets.

It could be expected that the increased length of the strip according to the present invention would tend to reduce the strength of the magnetic field at the knife edge. It has been found, however, that, in spite of the increased length of the strip, it is still possible, by appropriately selecting the shape and arrangement and the direction of magnetization of the magnets, to achieve an absolute strength and inhomogenity of the magnetic field at the knife edge that is comparable to that of the conventional magnet knife assembly, without having to use magnets with a larger overall size.

Preferably, the magnets of the knife assembly are held in position relative to the support structure only by the magnetic forces, so that these components are free to move relative to one another in the width direction of the assembly and differential thermal expansions will not lead to any strains or distortions.

In this embodiment, the length of the strip is selected such that a resultant magnetic force on the strip has the tendency to withdraw the knife edge portion of the strip into the gap between the two magnets and, conversely, to cause the opposite edge portion of the strip to project further from the magnets. Then, the support structure for the strip and the magnets may be formed by a substrate body having an outer surface and an internal cavity that communicates with the outer surface only through a narrow gap for accommodating the knife edge portion of the strip. The magnets are then accommodated in the cavity on either side of the strip, and the magnetic forces will tend to urge the strip against the bottom of the cavity, while the reaction forces acting upon the magnets tend to urge the magnets against walls of the substrate body that separate the cavity from the outer surface. In this way, the entire magnet knife assembly is clampingly held in position only by its own magnetic forces.

In a particularly preferred embodiment, the bottom of the cavity is formed with a step that is engaged by the edge portion of the strip opposite to the knife edge portion, and the magnets have cross-sectional shapes that assure that the magnetic forces of the magnets, that are supported by the substrate body create a torque acting on the strip so as to hold the same in engagement with the step in the bottom wall of the cavity.

BRIEF DESCRIPTION OF THE DRAWINGS

A preferred embodiment of the present invention will now be described in conjunction with the drawings, wherein.

DETAILED DESCRIPTION OF THE INVENTION

Figure 1A:
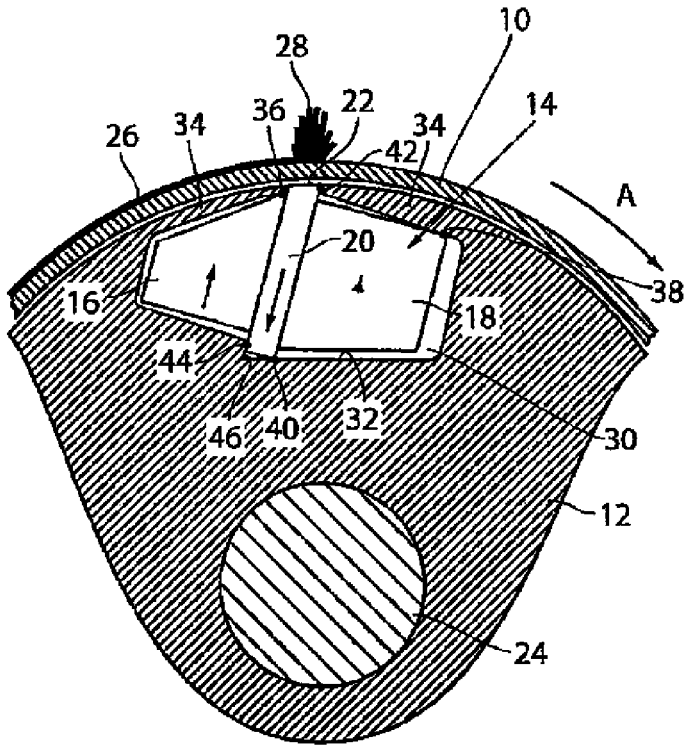
FIGS. 1A and 1B are each a partial cross-sectional view of an embodiment of a developing assembly comprising a magnet knife assembly according to the present invention.

As is shown in FIG. 1A, a first embodiment of a toner developing device comprises a thin-walled cylindrical sleeve 10 that surrounds a cylindrical, non-magnetic substrate body 12 in which a magnet knife assembly 14 is embedded.

The knife assembly 14 comprises two permanent magnets 16, 18 and a ferromagnetic strip 20 interposed therebetween. The strip 20 forms a knife edge 22 that is flush with the outer peripheral surface of the substrate body 12 and faces the internal surface of the sleeve 10.

The substrate body 12 is held stationary on a stationary shaft 24, whereas the sleeve 10, in operation, rotates in the direction of an arrow A (the drive mechanism is not shown).

As is generally known in the art of toner developing devices, in the first embodiment, a toner powder with magnetically attractable toner particles is uniformly applied to the surface of the rotating sleeve 10 so as to form a toner layer 26 that is then conveyed towards the knife edge 22 of the stationary magnetic knife with the rotation of the sleeve 10. A strong inhomogeneous magnetic field created by the magnets 16, 18 above the knife edge 22 causes the toner particles to form a toner brush 28 extending away from the outer surface of the sleeve 10. When an image forming medium (not shown) which may, for example, have a latent electrostatic charged image formed thereon, is moved past the magnetic brush 28, and a suitable voltage is applied between the image forming medium and the sleeve 10, a part of the toner particles will be attracted to the image forming medium so as to form thereon a toner image that corresponds to the charged image.

Figure 1B:
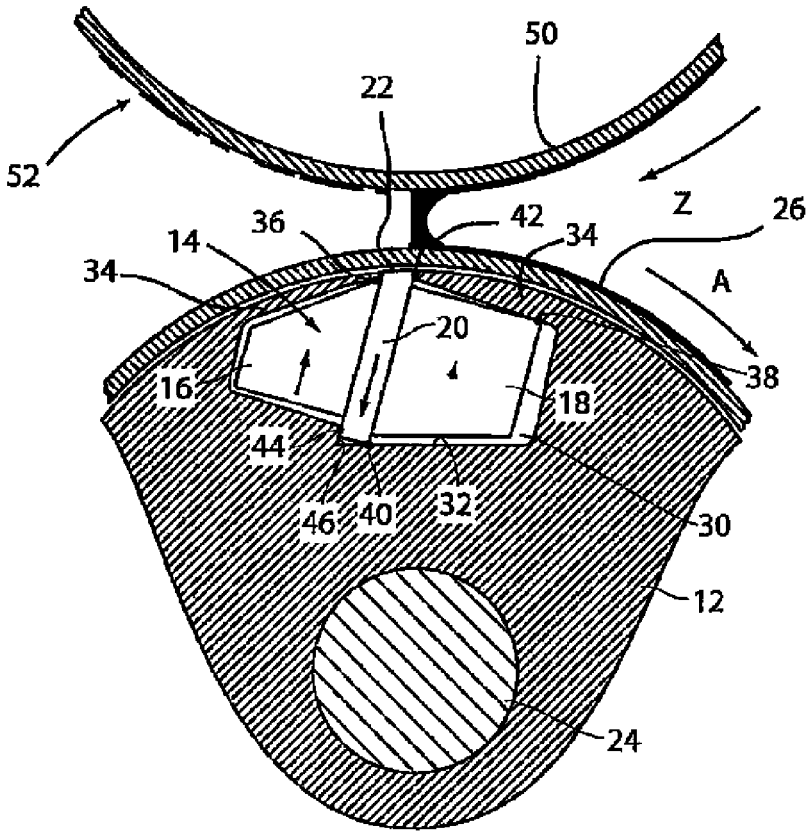

As is shown in FIG. 1B, a second embodiment of a toner developing device comprises a thin-walled cylindrical sleeve 10 that surrounds a cylindrical, non-magnetic substrate body 12 in which a magnet knife assembly 14 is embedded.

The knife assembly 14 comprises two permanent magnets 16, 18 and a ferromagnetic strip 20 interposed therebetween. The strip 20 forms a knife edge 22 that is flush with the outer peripheral surface of the substrate body 12 and faces the internal surface of the sleeve 10.

The substrate body 12 is held stationary on a stationary shaft 24, whereas the sleeve 10, in operation, rotates in the direction of an arrow A (the drive mechanism is not shown).

FIG. 1B further shows an image forming member 50. The image forming member 50 is rotatable in a direction Z.

In the second embodiment, as is known from the prior art, a toner powder with magnetically attractable toner particles is uniformly applied to the surface of the image forming member 50 so as to form a toner layer 26 that is then conveyed with the rotation of the image forming member 50 in the direction Z towards the knife edge 22 of the stationary magnetic knife. A strong inhomogeneous magnetic field created by the magnets 16, 18 above the knife edge 22 urges the toner particles towards the sleeve 10. Then, the sleeve 10 conveys the toner particles in the direction A.

When the image forming member 50 which may, for example, have an Electrical charge or voltage for attracting toner particles, is moved past the knife edge 22, and a suitable voltage is applied between the image forming medium and the sleeve 10, a part of the toner particles will be attracted to the image forming member 50 at each location where the electrical charge or voltage is provided on the image forming member 50. As a result particles attracted to the image forming member 50 will remain on the image forming member 50, while other toner particles will be moved to the sleeve 10 due to the presence of the magnetic field originating from the knife edge 22. Thus, a toner image 52 is formed at the outer surface of the image forming member 50.

It will be understood that the toner brush 28 and, consequently, also the sleeve 10, the substrate body 12 and the entire magnet knife assembly including the magnets 16, 18 and the strip 20 will extend over the entire width of the image forming medium in a direction normal to the plane of the drawing in FIGS. 1A and 1B. The magnets 16 and 18 are prismatic bodies which have the cross-sectional shape shown in FIGS. 1A and 1B. These magnets 16, 18 may be made of an NeFeB-alloy, for example, and are magnetized such that like magnetic poles, e.g., the N-poles, of the respective magnets are facing the strip 20. Although the magnets 16, 18 tend to repel one another, the presence of the strip 20 between them has the effect that both magnets are attracted by the strip and cling to the opposite sides of the strip.

In addition, as will be explained in detail as the description proceeds, the magnets 16, 18 and the strip 20 are subject to mutual magnetic forces that act in the direction of the length of the strip 20, i.e., the direction from the internal edge to the external knife edge 22 of the strip 20. These forces are indicated by arrows in FIGS. 1A and 1B.

As can be seen in FIGS. 1A and 1B, the magnets 16, 18 and the strip 20 are accommodated in a cavity 30 of the substrate body 12. This cavity 30 communicates with the outer peripheral surface of the body 12 only through a narrow gap which accommodates and is filled by the knife edge 22. As is indicated by the arrows in FIGS. 1A and 1B, the magnetic forces tend to draw the strip 20 back into the interior of the body 12 and urge the internal edge of the strip, i.e., the edge opposite to the knife edge 22, against a bottom surface 32 of the cavity 30.

Consequently, the reaction forces acting upon the magnets 16, 18 tend to urge these magnets outwardly against flange portions 34 of the body 12 which separate the cavity 30 from the external surface of the body 12 on either side of the strip 20. Due to the specific cross-sectional shape of the magnets 16, 18, these magnets are supported at the flange portions 34 at support points 36 and 38 (or rather support lines extending in the direction normal to the plane of the drawing in FIGS. 1A and 1B).

The strip 20 is inclined relative to the radial direction of the body 12 and the sleeve 10 by an angle of 15°, in this example. As a consequence, the strip 20 is supported at the bottom surface 32 of the cavity 30 only at a single support point 40. While in the illustrated embodiment, the single support point 40 coincides with a corner of the strip 20, the single support point 40 does not necessarily coincides with such a corner of the strip 20, which may depend on a shape of the strip 20 and a shape of the cavity 30.

Since, as is shown in FIGS. 1A and 1B, the support point 36 of the magnet 16 are located in close proximity to the strip 20, whereas the support point 38 of the other magnet 18 is located at the edge of this magnet facing away from the strip 20, and both magnets are urged upwardly against the flange portions 34, the whole magnet knife assembly 14 will be subject to a torque that tends to rotate the assembly clock-wise in FIGS. 1A and 1B. As a consequence, the outer portion of the strip 20, i.e., the portion forming the knife edge 22, is urged against a support point 42 at the tip end of one of the flange portions 34, and the opposite (internal) edge portion of the strip 20 is urged against a support point 44 at a step 46 formed in the bottom surface 32 of the cavity 30.

In the plane of the drawing of FIGS. 1A and 1B, the strip 20 has one rotational and two translational degrees of freedom, i.e., three degrees of freedom in total. The position of the strip 20 in each of these degrees of freedom is entirely determined by the three support points 40, 42 and 44. Since the magnets 16 and 18 are attracted by the strip 20, they may only slide along the length of the strip 20, i.e., each of them has only a Single degree of freedom, and this is determined by the support point 36 and 38, respectively.

Thus, the positions of all three components of the magnet knife assembly are entirely and uniquely determined, and the magnets 16, 18 and the strip 20 are held in their positions only by the magnetic forces acting therebetween and by the forces acting between these members and the substrate body 12. It will therefore be understood that the magnet knife assembly according to the invention can be assembled very easily just by thrusting the magnets 16, 18 (which may also be segmented over the width of the image forming medium), and the strip 20 into the cavity 32, so that they will automatically align themselves in the manner illustrated in FIGS. 1A and 1B.

Figure 2:
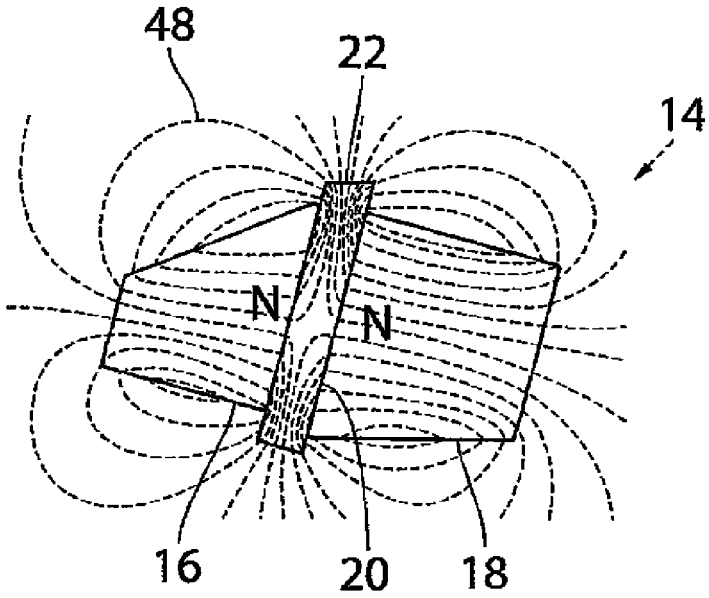
FIG. 2 is a diagram illustrating the configuration of a magnetic field created in and around the magnet knife assembly.

In FIG. 2, the geometry of the magnetic field created by the magnets 16 and 18 in and around the strip 20 is indicated by magnetic field lines 48. The two permanent magnets 16, 18 are magnetized in a direction essentially (but not necessarily exactly) normal to the strip 20, such that their north poles N are facing the strip 20. It can be seen that the magnetic field lines are "repelling" each other in a central portion of the strip 20, whereas they converge inside of the ferromagnetic strip 20 towards the knife edge 22. As is generally known, a non-magnetized ferromagnetic body that is brought into an inhomogeneous magnetic field experiences a resulting force in the direction in which the field becomes stronger. Thus, the outer portion of the strip 20 adjacent to the knife edge 22 experiences a force that tends to push the knife edge 22 away from the two magnets, so that the strip would tend to project further from the magnets.

However, in the shown embodiment, the length of the strip 22 is so large that a similar effect occurs in the internal edge portion of the strip. Here, the magnetic force tends to push the strip into the opposite direction (towards the bottom of the cavity 30 in FIGS. 1A and 1B). When the strip 20 is intended to assume a position in which its knife edge 22 projects a certain amount beyond the outer surfaces of the magnets 16, 18, the force that tends to push the strip 20 against the bottom of the cavity will increase with increasing length of the strip. Here, the length has been selected such that the force acting towards the bottom surface 32 of the cavity dominates the force that tends to push the knife edge 22 away from the magnets, as has been explained in conjunction with FIGS. 1A and 1B.

Figure 3:
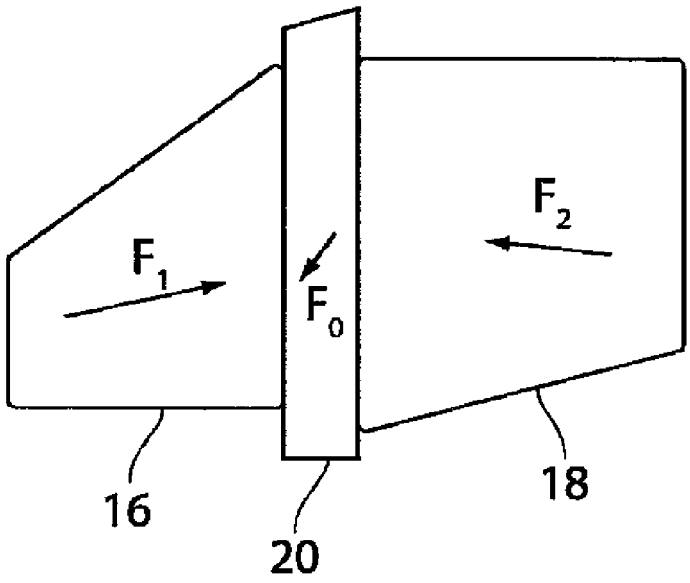
FIGS. 3 and 4 are diagrams illustrating magnetic forces that act between different components of the magnet knife assembly.
Figure 4:
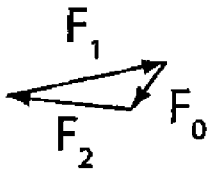

In FIGS. 3 and 4, F1 is a vector of the resultant magnetic force that the magnet 16 experiences from the strip 20 and the magnet 18; F2 is the vector of the magnetic force that the magnet 18 experiences from the magnet 16 and the strip 20; and F0 is the vector of the resultant magnetic force that the strip 20 experiences from the magnets 16 and 18. As is shown in FIG. 4, these three force vectors sum up to zero. The components of the force vectors directed normal to the plane of the strip 20 will only have the effect to urge the magnets 16 against the opposite faces of the strip 20, whereas the components of these forces in parallel with the strip 20 (the forces shown in FIGS. 1A and 1B) provide the desired self-aligning effect.

Figure 5:
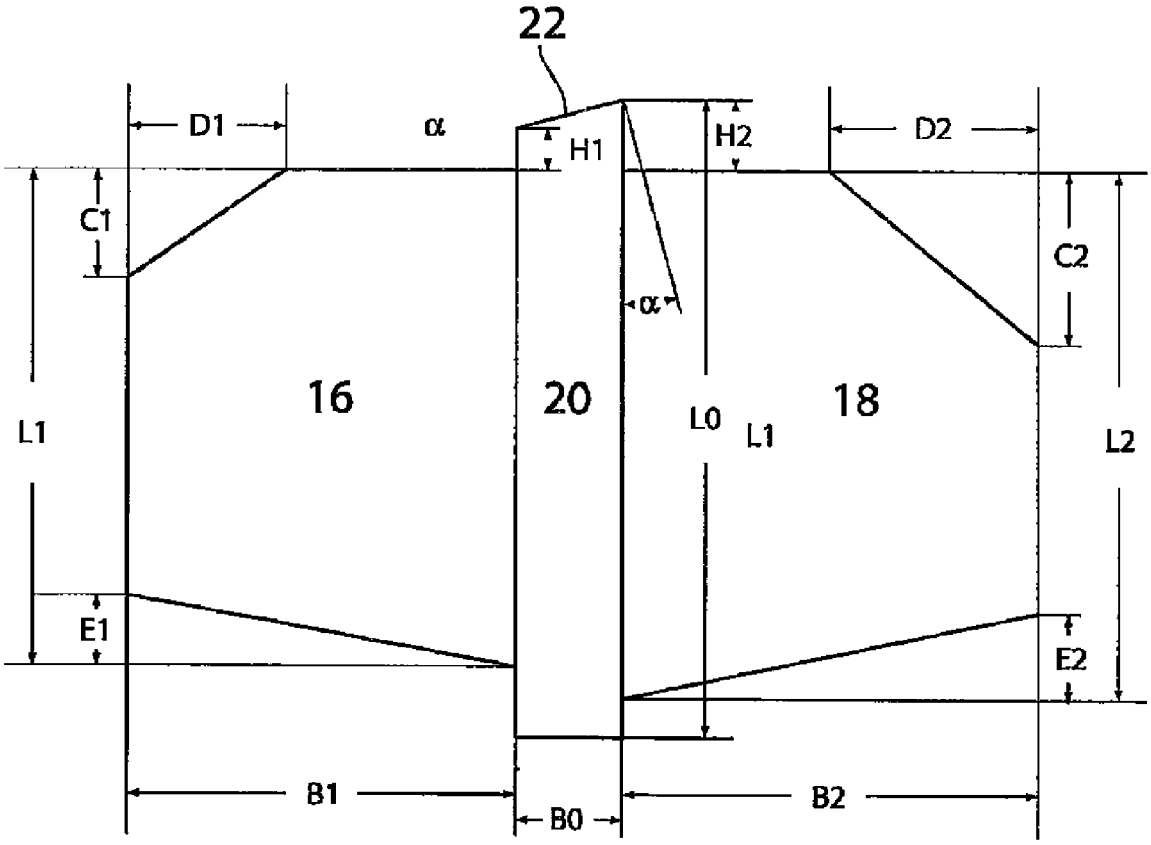
FIG. 5 is a diagram illustrating geometrical parameters of the magnet knife assembly.

FIG. 5 illustrates the general shape of the magnets 16, 18 and the strip 20 and indicates the relevant dimensions. L0 is the total length of the strip 20. L1 and L2 are the corresponding lengths of the magnets 16 and 18, respectively, and B0, B1 and B2 are the thicknesses of the strip 20 and the magnets 16, 18, respectively.

The basic shape of the magnets 16 and 18 is rectangular (with length L1 or L2 and width B1 or B2). In the shown embodiment, the magnets 16 and 18 are provided with a full-width chamfer with a height E1 and E2, respectively, at their bottom side (facing the bottom surface 32 of the cavity) and chamfers with a height C1, C2 and width D1, D2, respectively, on their top sides facing the flange portions 34. H1 and H2 are the distances which the knife edge 22 projects beyond the magnets 16 and 18, respectively, on either side of the strip 20. The angle a is the angle which the lengthwise direction of the strip 20 forms with the radial direction of the substrate body 12.

In the example shown in FIGS. 1A, 1B, 2 and 3, these dimensions have the values indicated below. It is noted that these values are merely exemplary and other values may as well be used in accordance with the present invention.

L0: 9 mm
L1: 7 mm
L2: 7.5 mm
B0: 1.5 mm
B1: 5.5 mm
B2: 6.5 mm
C1: 4 mm
C2: 0 mm
D1: 5.5 mm
D2: 0 mm
E1: 0 mm
E2: 1.74 mm
H1: 1 mm
H2: 1 mm
a: 15°

Other parameters that may be varied in order to optimize the magnetic field at the knife edge 22 are the angles that the directions of magnetisation of the magnets 16, 18 form with the strip 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A magnetic knife assembly for a toner developing device which comprises:

a support body, and a ferromagnetic strip held between like poles (N) of two permanent magnets, said ferromagnetic strip and said permanent magnets being disposed within said support body, said ferromagnetic strip extending between these poles to form a knife edge that faces outwardly of the support body and an inner edge that faces inwardly of the support body whereby the ferromagnetic strip is held such that an outer knife edge portion projects outwardly beyond the two magnets and is subjected to a magnetic force that tends to urge the strip in a direction where the knife edge portion projects further out of the magnets, wherein a length L0 of the strip from said knife edge to the inner edge is selected such that a portion of the strip opposite to the knife edge and closer to the inner edge is subject to a magnetic force that is larger than the force acting upon the knife edge portion, and the strip is held in position relative to the support body only by the magnetic forces of the magnets that urge the inner edge of the strip against the support body in the direction from the knife edge to the inner edge.

2. The magnet knife edge assembly according to claim 1, wherein the magnets and ferromagnetic strip are accommodated in a cavity of the support body, and the support body has an external surface that communicates with the cavity through a gap which accommodates the knife edge.

3. The magnet knife assembly according to claim 2, wherein the magnets are held in position relative to the support body by being urged against the walls of the cavity (30) by magnetic reaction forces which the strip exerts on the magnets.

4. The magnet knife assembly according to claim 3, wherein the cross-section of each magnet is supported at a flange portion separating the cavity from the external surface of the support body at only a single support point, and the strip is supported at a bottom surface of the cavity at a support point.

5. The magnet knife assembly according to claim 4, wherein a bottom surface of the cavity has a step and said support points of the magnets are arranged at different distances from the strip such that, when the magnets are urged against the flange portions at said support points, the entire magnet knife assembly experiences a torque tending to urge the knife edge portion of the strip against a tip end of one of the flange portions the opposite end portion of the strip against the step.

6. The magnet knife assembly of claim 2, wherein the ferromagnetic strip has one rotational and two translational degrees of freedom and each of said magnets has a single degree of freedom whereby the ferromagnetic strip and the magnets achieve automation alignment within the cavity.

7. A toner developing device containing the magnetic knife assembly of claim 1.

8. A magnetic knife assembly for a toner developing device which comprises:

a support body, and a ferromagnetic strip held between like poles (N) of two permanent magnets, said ferromagnetic strip and said permanent magnets being disposed within said support body, said ferromagnetic strip extending between these poles to form a knife edge that faces outwardly of the support body and an inner edge that faces inwardly of the support body whereby the ferromagnetic strip is held such that an outer knife edge portion projects outwardly beyond the two magnets and is subjected to a magnetic force that tends to urge the strip in a direction where the knife edge portion projects further out of the magnets, wherein a length L0 of the strip from said knife edge to the inner edge is selected such that a portion of the strip opposite to the knife edge and closer to the inner edge is subject to a magnetic force that is larger than the force acting upon the knife edge portion, and the strip is held in position relative to the support body only by the magnetic forces of the magnets that urge the inner edge of the strip against the support body in the direction from the knife edge to the inner edge, and wherein the cross-section of each magnet is supported at a flange portion separating the cavity from the external surface of the support body at only a single support point, and the strip is supported at a bottom surface of the cavity at a support point.

9. The magnet knife assembly according to claim 8, wherein a bottom surface of the cavity has a step and said support points of the magnets are arranged at different distances from the strip such that, when the magnets are urged against the flange portions at said support points, the entire magnet knife assembly experiences a torque tending to urge the knife edge portion of the strip against a tip end of one of the flange portions and the opposite end portion of the strip against the step.

10. The magnet knife assembly of claim 8, wherein the ferromagnetic strip has one rotational and two translational degrees of freedom and each of said magnets has a single degree of freedom whereby the ferromagnetic strip and the magnets achieve automation alignment within the cavity.

11. A toner developing device containing the magnetic knife assembly of claim 8.

* * * * *